US010005582B2

(12) United States Patent
Wolff

(10) Patent No.: US 10,005,582 B2
(45) Date of Patent: Jun. 26, 2018

(54) LABELLING DEVICE, LABELLING SYSTEM AND METHOD FOR AFFIXING A LABEL TO A PRODUCT

(71) Applicant: ESPERA-WERKE GMBH, Duisburg (DE)

(72) Inventor: Peter Wolff, Swifttal-Heimerzheim (DE)

(73) Assignee: ESPERA-WERKE GmbH, Duisburg (DE)

( * ) Notice: Subject to any disclaimer, the term of this patent is extended or adjusted under 35 U.S.C. 154(b) by 82 days.

(21) Appl. No.: 15/034,528

(22) PCT Filed: Jan. 9, 2015

(86) PCT No.: PCT/EP2015/050300
§ 371 (c)(1),
(2) Date: May 4, 2016

(87) PCT Pub. No.: WO2015/121003
PCT Pub. Date: Aug. 20, 2015

(65) Prior Publication Data

US 2017/0217622 A1 Aug. 3, 2017

(30) Foreign Application Priority Data

Feb. 11, 2014 (DE) ..... 10 2014 001 741

(51) Int. Cl.
*B65C 9/46* (2006.01)
*B65C 1/02* (2006.01)

(52) U.S. Cl.
CPC ..... *B65C 1/026* (2013.01); *B65C 9/46* (2013.01)

(58) Field of Classification Search
CPC .. B65C 1/026; B65C 9/40; B65C 9/46; B65C 2009/404
USPC ..... 156/64
See application file for complete search history.

(56) References Cited

U.S. PATENT DOCUMENTS

2015/0007936 A1 1/2015 Bernhard et al.
2015/0274436 A1* 10/2015 Di Donna ..... B65G 47/24 414/751.1

FOREIGN PATENT DOCUMENTS

| | | | |
|---|---|---|---|
| BR | PI0605049 | A | 6/2008 |
| CN | 202279283 | U | 6/2012 |
| CN | 102756832 | A | 10/2012 |
| EP | 1734349 | A2 | 12/2006 |
| GB | 2076167 | A | 11/1981 |

(Continued)

*Primary Examiner* — George Koch
(74) *Attorney, Agent, or Firm* — Rankin, Hill & Clark LLP

(57) ABSTRACT

The invention relates to a labelling device (1), in particular price labelling device, for providing a product (2) with a label (3), with at least one scale (4) for weighing the product (2), with at least one handling system (5) for moving the product (2) and with at least one printer (6) comprising a label outlet (6.1) for printing and outputting labels (3). In order to reduce the complexity, the invention proposes that the handling system (5) can be moved from a product pickup position (I), in which the product (2) can be picked up by the handling system (5), to a first label acceptance position (II), which is located adjacent to the label outlet (6.1) of the printer (6) and in which a first label (3) can be transferred onto the product (2). Furthermore, the invention relates to a labelling system (11) with multiple such labelling devices (1) and to a method for providing a product (2) with a label (3).

24 Claims, 2 Drawing Sheets

(56) References Cited

FOREIGN PATENT DOCUMENTS

Figure 1:
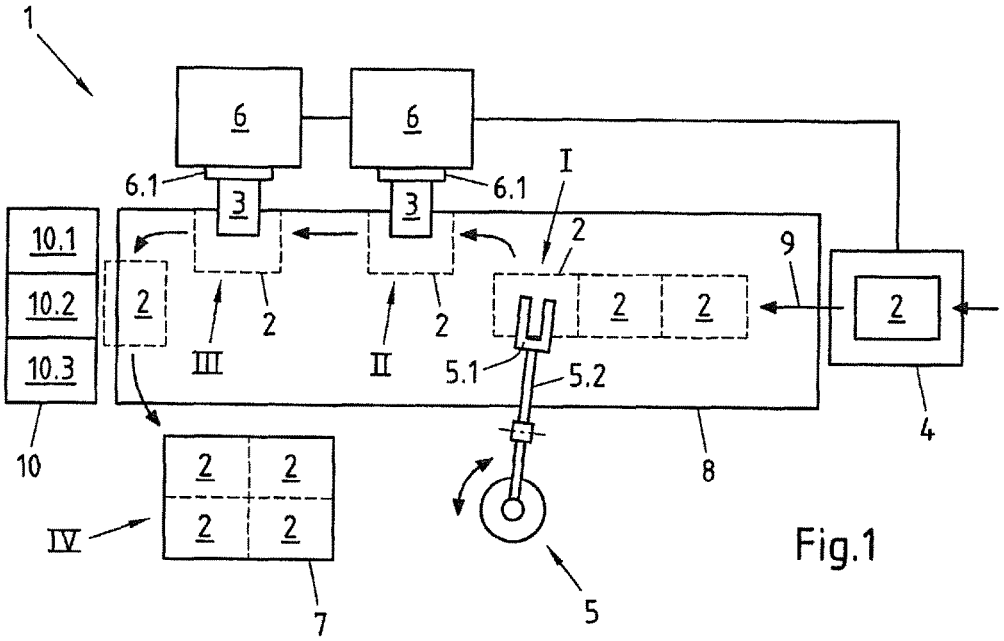

| | | | |
|---|---|---|---|
| JP | H0692335 | A | 4/1994 |
| JP | H08318919 | A | 12/1996 |
| JP | 2002255138 | A | 9/2002 |
| JP | 2004149125 | A | 5/2004 |
| JP | 2013230511 | A | 11/2013 |
| WO | 2007118290 | A1 | 10/2007 |

* cited by examiner

LABELLING DEVICE, LABELLING SYSTEM AND METHOD FOR AFFIXING A LABEL TO A PRODUCT

This application is a 371 of PCT/EP2015/050300, Filing Date Jan. 9, 2015.

The invention relates to a labelling device, in particular a price labelling device, for affixing a label to a product, with at least one scale for weighing the product, with at least one handling system for moving the product and with at least one printer having a label outlet for printing and outputting labels.

The invention, furthermore, relates to a labelling system with multiple such labelling devices.

Finally, the invention relates to a method for affixing a label to a product, with which the following steps are carried out:

- providing the product, in particular by transporting the product,
- weighing the product,
- printing a first label and positioning the first label in a first label acceptance position,
- moving the product from a product pickup position to the first label acceptance position, wherein the first label is picked up by the product and adheres thereon, and
- moving the product away from the first label acceptance position.

From the prior art it is known to furnish products, that is goods or packages, with labels which contain product information. Product information among other things can be the weight and/or the basic or selling price of the produce or preferences to discount promotions. Here, the selling price frequently depends on the weight of the product. In order to obtain the necessary data for printing out weight-dependent product information, the product has to be initially weighed.

For weighing a product it is known to place the same onto a scale manually or in an automated manner. For example, the scale can also be integrated in a conveyor belt so that the product is automatically transported onto the scale, weight and transported onwards from there. The data detected by the scale, that is the weight or the data corresponding to the weight is transmitted if appropriate via a separate computer, to a label printer which prints out the information corresponding to the data on a label.

Such labels are usually self-adhesive labels which are detachably attached to a substrate strip. Alternatively it is also known to cut labels off a material strip (without separate substrate strip)—the labels in the latter case are created by cutting off a section of material strip forming the label. The substrate strip or the material strip provided with labels can be fed to the printer as roll material (continuous strip).

The printed-out label has an adhesive surface (adhesive side of the label) on the side located opposite the print. With this adhesive surface, the label is stuck onto the package. To this end it is known from the prior art that a label manipulation system picks up the printed and singled-out label at the label outlet of the printer (this position is called label acceptance position) and moved to a location which the product on a transport belt passes. In the process, the label manipulation system positions the label in a manner that the product being transported on the transport belt during the transport movement automatically comes into contact with the label and the label thereby adheres to the product.

A labelling device of the type described before is a relatively complicated construction since the label manipulation system has to be designed so that it can remove the label from the label outlet and transport it to the product, namely without the label with its adhesive surface sticking to the label manipulation system. For this purpose, relatively complex suction apparatuses are known which are integrated in the label manipulation system and suck up the label in the label acceptance position on the printer or label outlet. The suction force has to be maintained during the transport to the product all the way.

It is therefore an object of the present invention to create a labelling device, a labelling system and a method for affixing a label to a product by way of which the complexity is reduced.

The previously derived and shown object is solved according to a first teaching of the present invention with a labelling device, in particular a price labelling device, for affixing, in particular gluing, a label to a product, for example a good or a package, having at least one scale for weighing the product, having at least one handling system for moving the product and having at least one printer comprising a label outlet for printing and outputting labels, in that the handling system can be moved from a product pickup position, in particular unambiguous product pickup position, in which the product can be picked up by the handling system, to a first label acceptance position, which is located adjacent to the label outlet of the printer and in which a first label can be transferred onto the product.

An unambiguous product pickup position is to mean a position which is assigned to a certain one of the weighed products. In this way it is ensured that following the weighing the respective product is provided with the correct label (assigned to the product or weighing operation).

Here, the scale can be configured so that it transmits the detected data, i.e. the weight of the product or the data corresponding to the weight of the product, directly or via a separate computer to the printer which prints information corresponding to the data on the labels. Obviously, the printer can additionally receive further data or print further product information on the labels. More than one printer can also be provided, wherein these can then be configured so that each printer prints the same information on the label; however it can also be conceivable that each printer prints information on the respective label that is distinct from the other printer(s). For example, a printer prints information regarding the weight, basic and selling price and another printer prints information regarding a discount promotion etc.

By a handling system being provided, which picks up, in particular grips, the product and directly leads to the respective label outlet of the printer, the label can be directly transferred from the label outlet to the product without the label having to be guided to the product with a separate label manipulation system. Otherwise, the product can be guided past multiple printers and accordingly label outlets so that with merely one continuous movement of the product more than one label can be transferred onto the product. As will still be explained in more detail in the following, the multiple, for example two, printers can be arranged in this case so that the product which is guided past the printers by the handling system initially passes the first and then the subsequent second printer. However, the printers can also be arranged so that the product simultaneously passes two printers which are for example arranged vertically on top of one another, so that two labels, namely one from each printer, can be transferred onto the product in short succession or on request even simultaneously.

According to a configuration of the labelling device according to the invention it is provided that the labelling device comprises at least one first and one second (if appropriate even a third, fourth etc.) printer each comprising a label outlet for printing and outputting labels, wherein the label outlet of the first printer is spaced vertically (i.e. in the direction of gravity) and/or horizontally from the label outlet of the second printer (and/or from the label outlet of the third printer etc.) and wherein the handling system can be moved both in the first label acceptance position, which is located adjacent to the label outlet of the first printer and in which a first label can be transferred onto the product, as well as in a second label acceptance position, which is located adjacent to the label of the second printer and in which a second label can be transferred onto the product. In this way, as already explained beforehand, the product can be guided past, in succession or simultaneously, multiple printers and/or label outlets as a result of which multiple labels can be correspondingly transferred onto the product in succession or simultaneously.

According to one variant it can be provided that the printers and/or the label outlets of the printers are orientated in such a manner that in the label acceptance position the adhesive sides of the labels to be dispensed via the two label outlets face one another. Accordingly it is conceivable that two printers are arranged (horizontally) next to one another or (vertically) on top of one another and the respective label outlet of each printer faces against (or in the) transport direction in which the product is fed to the printers or guided past the printers. Each of the two printers dispenses the labels in an own label acceptance position, i.e. the one printer in the first label acceptance position and the other printer in the second label acceptance position. Here, the adhesive surfaces of the labels to be dispensed from the two printers face one another. When then a product is transported into a region between both labels and/or label acceptance positions, both labels, that is the label from the one printer and the label from the other printer, can be transferred onto the product in quick succession in that the handling system initially moves the product to the one label (in the first label acceptance position) and then to the other label (in the second label acceptance position) before the product now provided with labels is then transported onwards.

According to a further variant, the first label acceptance position can be identical to the second label acceptance position. For it is also conceivable in principle that two printers are arranged (horizontally) next to one another or (vertically) on top of one another and the respective label outlet of the printer faces the respective other printer, so that both printers dispense the labels in the same (common) label acceptance position (the dispensing devices of the two labels then work in opposite direct). Both labels are held in the same label acceptance position until the product picks up the labels. Preferably, the adhesive surfaces of the labels dispensed from the two printers face against the transport direction in which the product is fed to the printers or guided past the printers. When a product is then guided through between both printers, both labels, that is the label from the one printer and the label from the other printer, can be likewise transferred onto the product in quick succession or even simultaneously.

Through the variants described above a label can be affixed to a product on different sides, for example on sides located opposite, without the product having to turn in the process. This has the advantage that the product during the labelling process does not come into contact inside with the often transparent product top, e.g. sealing foil, smudging the same.

Alternatively it is also conceivable that the handling system first passes the first label acceptance position and then the second label acceptance position. In this case, the first label is consequently first affixed to the product and then following this in another position which in product transport direction is located behind the first label acceptance position, the second label is affixed to the product. In this case, the printers are also preferentially spaced from one another in horizontal and/or vertical direction, wherein the labels however are then dispensed preferentially in parallel directions (dispensing directions) so that the product on being passed the label outlets, picks up in succession first the first and then the second (and then if applicable even additional) labels.

In principle it is also conceivable that one and the same printer prints out two different labels for affixing to different locations on the product. For this purpose it can be provided that the handling system in the first and/or second label acceptance position can be positioned relative to the label outlet in at least two different orientations. In other words, the part of the handling system which holds or grips the product can orientate the product relative to the respective label outlet in a different manner, for example by turning the product.

Preferably, because of the fact that the handling system in the first and/or second label acceptance position can be positioned relative to the label outlet in at least two different orientations, a label can also be affixed over a corner (i.e. over a lateral edge of the product) or over multiple sides of the product.

To avoid the product when affixing the dispensed label to come into contact with the label outlet, the distance between the label outlet of the respective printer and the respective label acceptance position according to a further configuration lies in a range from 0.1 to 10 cm, preferentially in a range from 0.1 to 5 cm, particularly preferably in a range from 0.1 to 1 cm. This distance corresponds to the smallest distance of the product from the label outlet at the time when the product picks up the label. In particular, the distance is smaller than the maximum label length. The respective printer is thus arranged relative to the respective label acceptance position so that the label can be dispensed onto the label acceptance position. In particular, the respective printer and/or the respective label outlet are/is stationary, i.e. the label is not moved after the printing until it is taken along by the product being guided past.

According to another configuration, the handling system can be moved into a packaging position which is located downstream of the first and/or second label acceptance position and in which the (labelled) product is placed on a carrier and in particular can be inserted into an outer package or provided with an outer package. In the packaging position, the product can be placed onto a carrier with further (labelled) products and in particular inserted into a common outer package or provided with a common outer package.

In principle it is also conceivable that even before the scale a packing of a (not yet weighed) good takes place, i.e. that a separate packaging machine is located upstream of the scale. The object, which is taken from the packaging machine located upstream of the scale is called "product" in terms of the invention, which, having passed through the labelling device according to the invention, can finally be put down on a carrier in the packaging position and in particular inserted in an outer package.

According to yet another configuration it is provided that the labelling device comprises at least two scales, if appropriate even three or four scales (or more), which are arranged next to one another and/or behind one another. In the case of four scales it is conceivable for example that two each are arranged next to one another and two each are arranged behind one another (2×2 arrangement). In this way, multiple products can be simultaneously weighed and processed in the labelling device according to the invention.

Furthermore it is provided according to a further configuration that the labelling device comprises a product buffer for receiving multiple products (also called accumulation section or accumulation conveyor), which is arranged downstream of the at least one scale and which is arranged adjacent to the at least one scale, wherein preferentially transport means for transporting the product from the at least one scale to the product buffer are provided, wherein the product receiving position is located within the product buffer or adjoining the product buffer. Such a product buffer or such an accumulation section means an intermediate storage section for the weighed products. From this intermediate storage section, the handling system in each case fetches a product (or if appropriate multiple products). Alternatively it is also conceivable that the handling system picks up the product directly from the respective scale, guiding it to the first label acceptance position and the positions following thereafter.

A product buffer can be a moving transport device or a stationary area with a relatively smooth surface. Relatively smooth means that the products can slide along the surface without being damaged. The transport device can be a transport belt or a roller conveyor, that is a plurality of rollers which are arranged one behind the other, if appropriate at least partly driven, with a parallel axis of rotation.

According to yet a further configuration it is provided that the labelling device comprises a quality control device with a vision system, in particular containing a camera and/or fluoroscopic unit, and/or with a leakage test system, in particular containing a device for testing the liquid tightness and/or gas tightness of the product and/or with a scanner, in particular barcode scanner, wherein the quality control device is located downstream of the at least one scale and/or the at least one printer, in particular the label acceptance position of the at least one printer and in particular is arranged upstream of the packaging position. In other words, the handling system can be brought into a position which can be detected by the quality control device and in particular by the vision system and/or leakage test system and/or scanner and from there in particular further to the packaging position. Correspondingly, the product is obviously also brought into the corresponding positions when the handling system during the operation as intended has picked up a product.

With a vision system the product, for example the package or good, can be subjected to an in particular automatical visual test. During a leakage test it can be checked if the product or the package is liquid-tight and/or gas-tight. With a scanner, a part of the information or the entirety of information on the label that is present on the product, for example a barcode, can be read out for test purposes.

According to yet a further configuration it is provided that the handling system comprises a product holding unit with means for fixing the product on the handling system, in particular with a gripper (gripping mechanism), and a translocating unit that is coupled to the product holding unit, in particular a robot arm, wherein the product holding unit (with the product) can be moved by means of the translocating unit into the product pickup position and into the first label acceptance position as well as into the second label acceptance position and/or the packaging position if appropriate. The translocating unit is thus designed so that the product holding unit collected with the same can be guided along a section (movement path, in particular orbital path) namely by means of the translocating unit, wherein on this section the mentioned positions (product pickup position, first label acceptance position, if appropriate second label acceptance position, if appropriate further label acceptance positions, if appropriate packaging position product) are located. The product holding unit thus passes (with the product) the mentioned positions.

The previously derived and shown object is solved furthermore according to a second teaching of the present invention with a labelling system having multiple, for example two, labelling devices as defined before in that the labelling devices which are preferentially arranged parallel to one another, have a common product buffer which is located downstream of the scales and which is arranged adjacent to the scales, wherein transport means for transporting the product from the respective scale to the product buffer are provided, wherein the respective product pick up position is located within the product buffer or adjoining the product buffer. Otherwise, the product buffer is designed as in the case of the labelling device described above. In other words, two (or more) labelling devices are provided which share a common product buffer.

With a labelling system of the type described above a plurality of products can be simultaneously weighed in a simple manner in the manner described above and provided with one or more labels, if appropriate then passes through a quality control and can be finally packed if appropriate.

The previously derived and shown object is finally solved according to a third teaching of the present invention through a method for providing a product with a label, in particular affixing a label to a product, in particular a good or package, in particular using a labelling device as defined above or a labelling system as defined above, during which the following steps are carried out:

- providing the product, in particular by transporting the product,
- weighing the product,
- if appropriate, transporting the weighed product into an in particular unambiguous product pickup position (waiting position),
- fixing the product on a handling system in the or an in particular unambiguous product pickup position,
- printing a first label and positioning the first label in a first label acceptance position,
- moving the handling system together with the product from the product pickup position to the first label acceptance position, wherein the first label is picked up by the product and adhere to the same, and
- moving away of the handling system together with the product from the first label acceptance position.

According to a configuration of the method according to the invention it is provided that a second label is printed and positioned in a second label acceptance position, wherein the first label acceptance position is identical to the second label acceptance position and wherein during the step of the moving of the handling system together with the product from the product pickup position into the first label acceptance position the second label, in particular simultaneously with the first label, is picked up by the product and adheres thereon. As mentioned, even two (or more) labels can be printed and transferred onto the product, wherein two (or more) labels are picked up simultaneously or one after the other by the product or can be transferred onto the product.

If the first label acceptance position and the second label acceptance position are identical, the labels can be applied to the product simultaneously. If the labels are to be applied to the product one after the other it can be provided that a second label is printed and positioned in a second label acceptance position, wherein the second label acceptance position is arranged downstream of the first label acceptance position, wherein the handling system together with the product is moved from the first label acceptance position to the second label acceptance position, wherein the second label is picked up by the product and adheres thereon.

Independently of whether the labels are picked up simultaneously or one after the other by the product, the first label and the second label preferentially adhere to different, in particular opposite, sides of the product to the same.

It is also conceivable that the handling system in the first and/or second label acceptance position is positioned relative to the label outlet in at least two different orientations and in particular the respective label or multiple labels is/are applied over a corner or over multiple sides of the product.

According to a further configuration of the method according to the invention, the handling system together with the product is moved from the first label acceptance position or the second label acceptance position into a packaging position, in which the (labelled) product, if appropriate with further (labelled) products, is put down on a carrier and inserted in particular into an outer package or provided with an outer package (the outer package then forms the carrier).

Once the handling system has put down/inserted the product, i.e. the product is detached from the handling system, the handling system can again be moved to the or to an unambiguous product pickup position, in order to pick up a further product there. While the handling system with a product moves away from the product pickup position and/or while the handling system (following the putting down/inserting) moves from the packaging position to the respective product pickup position, a further product can already be weighed. If appropriate, while the handling system with a product moves away from the respective label acceptance position and/or while the handling system moves from the packaging position to the respective product pickup position, a label for a further product can already be printed.

Furthermore, it can be provided according to a further configuration that during the step of the weighing multiple products are weighed simultaneously. The data of the various weighed products are preferentially transmitted to the respective printer or printers, if appropriate subject to connecting a separate computer in between.

As has likewise already been explained during the description of the labelling device according to the invention, it can be provided with the method that following the step of the weighing the product or the products is/are transported from the scale to a product buffer, wherein the product pickup position is located within the product buffer or adjoining the product buffer. In principle it is also conceivable, however, that the product or the products is/are picked up directly (without intermediate connection of a product buffer) from the scale by the handling system following the step of the weighing, i.e. directly fixed on the scale on the handling system. The position on the scale in which the respective product is fixed on the handling system is then the unambiguous product pickup position.

The (labelled) product can also pass through a quality control device, in particular with a vision system and/or a leakage test and/or a scanner.

Preferentially, multiple products can simultaneously pass through the following method steps in the case of the method according to the invention:

providing the product, in particular by transporting the product, weighing the product, if appropriate, transporting the weighed product into a unambiguous product pickup position (waiting position), fixing the product on a handling system in a product pickup position, printing a first label and positioning the first label in a first label acceptance position, moving the handling system together with the product from the product pickup position to the first label acceptance position, wherein the first label is picked up by the product and adheres there one, and moving away the handling system together with the product from the first label acceptance position.

Figure 2A:
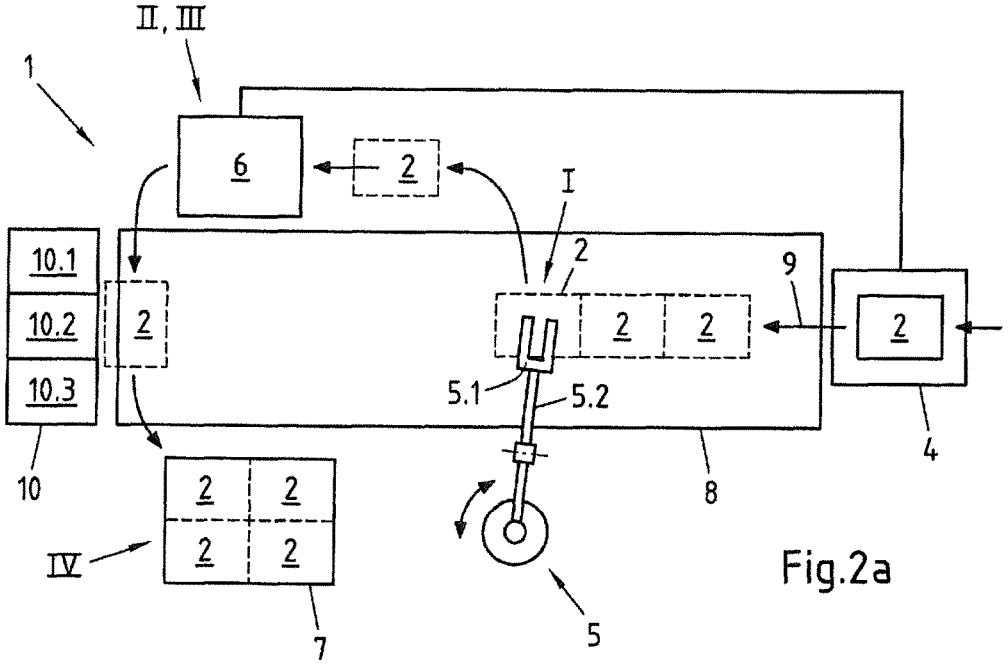
Figure 2B:
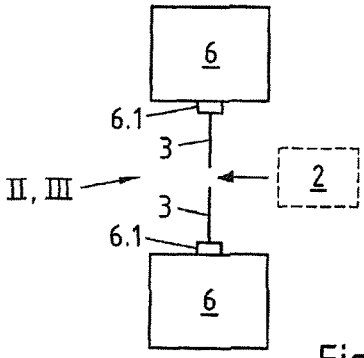
Figure 2C:
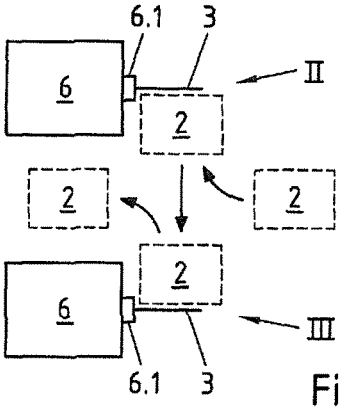
Figure 3:
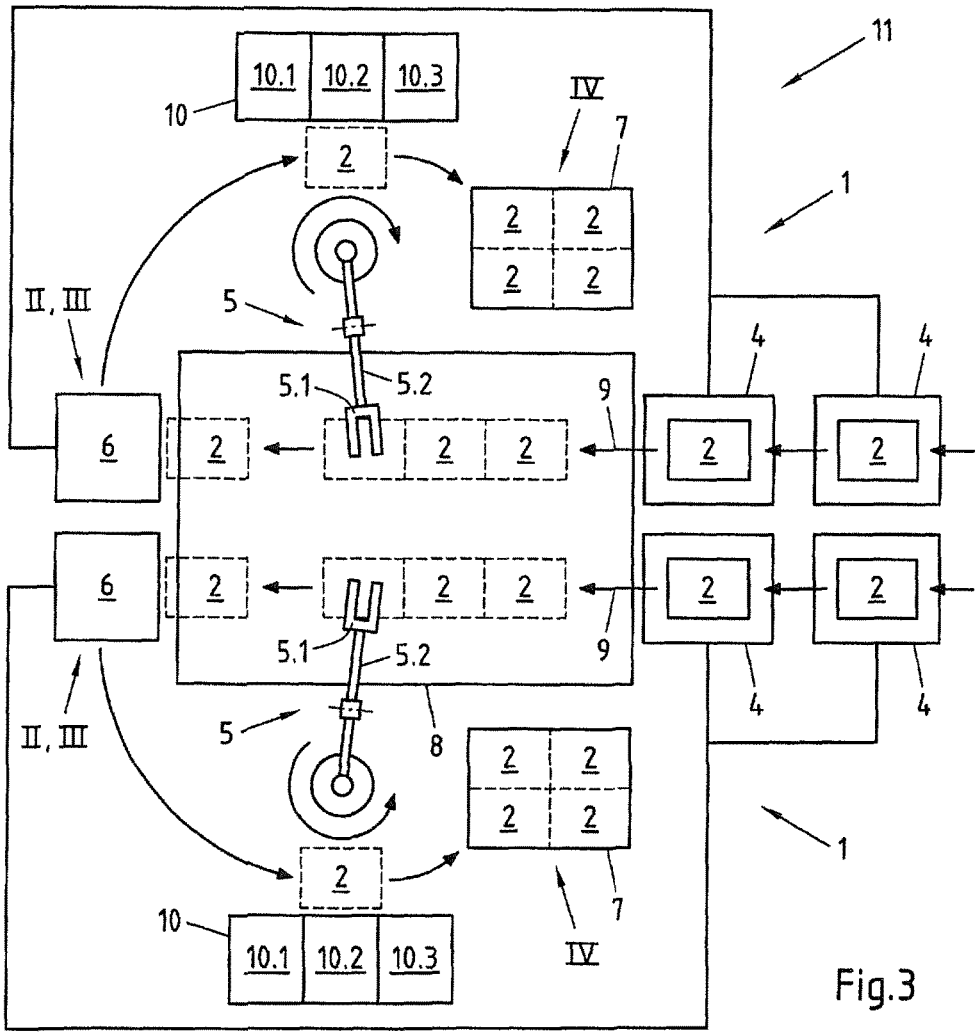

Multiple products can also simultaneously pass through one or multiple of the remaining method steps described. There is now a plurality of possibilities of configuring and further developing the labelling device according to the invention, the labelling system according to the invention and the method according to the invention. In this regard reference is made on the one hand to the claims following claim 1, on the other hand to the description of exemplary embodiments in conjunction with the drawing. In the drawing it shows:

FIG. 1 a first exemplary embodiment of a labelling device according to the invention, FIG. 2*a*) a second exemplary embodiment of a labelling device according to the invention, FIG. 2*b*) a part view of a section of the labelling device from FIG. 2*a*) which is turned by 90° relative to FIG. 2*a*), FIG. 2*c*) an alternative to the labelling device from FIG. 2*b*) and FIG. 3 an exemplary embodiment of a labelling system according to the invention with two labelling devices.

In the figures, exemplary embodiments of a labelling device 1 for affixing a label 3 to a product 2 are shown. The product 2 passes through various positions which in the figures are schematically shown in the form of interrupted lines.

The labelling device 1 in FIG. 1 is equipped with a single scale 4 for weighing the product 2. FIG. 1 shows the state in which a product 2 is already present on the scale 4. The product 2 can be a good which has been provided with a package beforehand, for example in a packaging machine (not shown) located upstream of the scale 4.

The labelling device furthermore comprises a handling system 5 for moving the product 2 and two printers 6 which each comprises a label outlet 6.1 for printing and outputting labels 3. Substantially in the region between the scale 4 and the printers 6, a product buffer 8 is provided, which for example consists of a plurality of non-driven rollers with parallel axes of rotation that are arranged one behind the other. In addition, an outer package 7 as carrier is shown which serves for receiving multiple of the labelled products 2. Furthermore, a quality control device 10 is provided, which comprises a vision system 10.1, a leakage test system 10.2 and a scanner 10.3.

Following the weighing, the product 2 is transported to the product buffer 8 via transport means 9, which are schematically shown by an arrow here, where the products 2 are intermediate-stored. The handling system 5, which comprises a product holding unit 5.1 with a gripper for fixing the product 2 on the handling system 5 and a translocating unit 5.2 that is coupled to the product holding unit 5.1 in the form of a robot arm, picks up a weighed product in a product pickup position I from the product buffer 8 and moves the same initially to a first label acceptance position II, which is located adjacent to the label outlet 6.1 of the first printer 6 and in which a first label 3 can be transferred onto the product 2.

As is evident in FIG. 1, the label 3 projects from the first printer 6 or the associated label outlet 6.1 so far that it automatically comes into contact with the product 2 in the first label acceptance position II and adheres thereon. The product 2 is subsequently moved onto a second label acceptance position III which is horizontally spaced from the first label acceptance position II, which label acceptance position III is located adjacent to the label outlet 6.1 of the second printer 6 and in which a second label 3 can be transferred onto the product 2. Here, too, the label 3 is automatically touched by the product 2 and picked up. In the process, the label 3 that is applied in the first label acceptance position II in the present exemplary embodiment is applied to the top side of the product 2, i.e. to the product side facing against the gravity direction and the label 3 that is applied in the second label acceptance position III to the lower side of the product 2, that is to the product side facing in gravity direction. In other words, the product 2 is provided with a label 3 on opposite sides without having to turn the product 2 in the process. Because of this, the product 2 during the labelling process does not come into contact inside with the product top side, for example transparent sealing foil and therefore does not smudge the same.

On the labels 3, information is printed which corresponds to data or was generated from data that was detected by the scale 4 during the weighing process, for example the weight of the product 2. Accordingly, the scale 4 and the printers 6 and if appropriate a separate computer (not shown) are connected to one another for secure transmission of data.

After the labels 3 have been affixed to the product, the product is transported via the handling system 5 to a further station or position, in which the quality control device 10 is located. For control purposes, the quality control device 10 can visually show and/or fluoroscope the product 2 and thereby carry out an automatic visual inspection via the vision system 10.1. Additionally or alternatively, a leakage test system 10.2 can check the tightness, in particular liquid tightness and/or gas tightness of the product 2. Finally, the scanner can read in the information on one or all labels, in particular a barcode for verification purposes.

Following this, likewise by the handling system 5, the product 2 is moved further to a packaging position IV, in which the handling system 5 places the product 2 into an outer package 7. One after the other, multiple products 2 can be inserted in the outer package 7 here.

FIG. 2*a*) shows a further exemplary embodiment of a labelling device 1 according to the invention. The construction and the functioning are identical to those described above by way of FIG. 1 except for the following differences.

The exemplary embodiment in FIG. 2*a*) differs from the exemplary embodiment in FIG. 1 in that according to FIG. 2*a*) the two printers 6 are not horizontally arranged next to one another, but vertically on top of one another, which is schematically shown by the two versions in FIGS. 2*b*) and 2*c*).

In the version in FIG. 2*b*), the two label outlets 6.1 are each orientated in the direction of the other printer 6, so that the dispenser direction of the one printer 6 runs opposite to the dispenser direction of the printer 6 located opposite. The two labels 3 project into the vertical region between the two printers 6 so that in the case that the product 2 is passed through between the two printers 6 by the handling system 5, both labels 3 can simultaneously adhere to the product 2. In this case, the first label acceptance position II and the second label acceptance position III are identical.

In the version in FIG. 2*c*), the two label outlets 6.1 of the printers 6 are orientated against the transport direction, in which the product 2 is fed to the printers 6 or guided past the printers 6. Each of the two printers 6 dispenses the respective label 3 in an own label acceptance position II or III, i.e. the in the representation upper printer 6 into the first label acceptance position II and the in the representation lower printer 6 into the second label acceptance position III. In this example, the adhesive surfaces of the labels 3 dispensed from the two printers 6 face one another. The handling system 5 transports the product 2, as shown by the arrows in FIG. 2*c*), into a region between the dispensed labels 3 and there once to the upper label (into the first label acceptance position II) and then to the lower label (into the second label acceptance position III) or vice versa, before the product 2 that is now provided with the two labels 3 is then transported on.

FIG. 3 finally shows a labelling system 11 which comprises two labelling devices 1, each of which in their function and their construction correspond to the exemplary embodiment according to FIG. 2*a*)—only the arrangement of the individual stations is slightly different than in FIG. 2*a*).

Both labelling devices 1 share a common product buffer 8, wherein multiple scales 4 are arranged upstream of the product buffer 8, on which multiple products 2 can be weighed simultaneously. The weighed products 2 are then transported onto the product buffer 8 where they are intermediate-stored in two rows. The respective first product 2 of each row is then picked up by a respective handling system 5 and, as already explained during the description of FIG. 2*a*), initially passed through between two printers 6 that are vertically spaced from one another, subsequently guided past a quality control device 10 and finally placed into an outer package 7.

The two labelling devices 1 are mirror-symmetrically constructed and each comprises two scales 4, one handling system 5 and two printers 6 (arranged on top of one another). Furthermore, each labelling device 1 has an own quality control device 10 and an own station for inserting the products 2 into an outer package 7.

The invention claimed is:

1. A labelling device for providing a product with a label comprising:

at least one scale for weighing the product;

at least one handling system for moving the product; and at least one printer comprising a label outlet for printing and outputting labels;

wherein the handling system comprises a product holding unit with means for fixing the product on the handling system, and a robot arm that is coupled to the product holding unit, wherein the handling system is configured to move from a product pickup position, in which the product can be picked up by the handling system, to a first label acceptance position, which is located adjacent to the label outlet of the printer and in which a first label can be transferred onto the product, wherein the product holding unit by means of the robot arm is configured to move into the product pick-up position and into the first label acceptance position, and wherein either (a) the product pickup position is a position on the at least one scale, or (b) the labelling device has a product buffer for picking up a plurality of products which is mounted downstream of the at least one scale and which is disposed adjacent to the at least one scale, and the product pickup position is a position inside the product buffer or adjacent to the product buffer.

2. The labelling device according to claim 1, wherein the labelling device comprises at least one first and one second printer each comprising a label outlet for printing and outputting labels, wherein the label outlet of the first printer is horizontally and/or vertically spaced from the label outlet of the second printer, and wherein the handling system is configured to move both into the first label acceptance position, which is located adjacent to the label outlet of the first printer and in which a first label is transferrable onto the product, and also into a second label acceptance position, which is located adjacent to the label outlet of the second printer and in which a second label is transferrable onto the product.

3. The labelling device according to claim 2, wherein the handling system is configured to move from the first label acceptance position into the second label acceptance position.

4. The labelling device according to claim 3, wherein the printers and/or the label outlets of the printers are orientated in such a manner that in the label acceptance positions, the adhesive sides of the labels to be dispensed via the two label outlets face one another.

5. The labelling device according to claim 2, wherein the first label acceptance position is identical to the second label acceptance position.

6. The labelling device according to claim 1, wherein the handling system in the first label acceptance position is configured to be positioned relative to the label outlet in at least two different orientations.

7. The labelling device according to claim 1, wherein the handling system is configured to move into a packaging position, which is located downstream of the first label acceptance position and/or a second label acceptance position, and in which the product is put down on a carrier and inserted into an outer package.

8. The labelling device according to claim 1, wherein the labelling device comprises at least two scales which are arranged next to one another and/or behind one another.

9. The labelling device according to claim 1, wherein the labelling device comprises the product buffer for receiving multiple products, which is located downstream of the at least one scale and which is arranged adjacent to the at least one scale, and the product pickup position is located within the product buffer or adjoining the product buffer.

10. The labelling device according to claim 1, wherein the labelling device comprises a quality control device with one of a vision system and a leakage test system and a scanner, wherein the quality control device is located downstream of the at least one scale or the at least one printer.

11. A labelling system with multiple labelling devices according to claim 1, wherein the labelling devices comprise a common product buffer, which is located downstream of the scales and which is arranged adjacent to the scales, wherein transport means for transporting the product from the respective scale to the product buffer are provided, and wherein the respective product pickup position is located within the product buffer or adjoining the product buffer.

12. A method for providing a product with a label, the method comprising:

providing the product;

weighing the product with at least one scale;

fixing the product on a handling system in a product pickup position, wherein the handling system comprises a product holding unit with means for fixing the product on a handling system, and wherein the handling system picks up the product;

printing a first label and positioning the first label in a first label acceptance position;

moving the handling system together with the product from the product pickup position to the first label acceptance position, wherein the first label is picked up by the product and adheres thereon, wherein the handling system comprises a robot arm that is coupled to the product holding unit, and wherein the product holding unit by means of the robot arm is moved into the product pick-up position and into the first label acceptance position; and moving the handling system together with the product away from the first label acceptance position, and wherein either (a) the product pickup position is a position on the at least one scale, or (b) the labelling device has a product buffer for picking up a plurality of products which is mounted downstream of the at least one scale and which is disposed adjacent to the at least one scale, and the product pickup position is a position inside the product buffer or adjacent to the product buffer.

13. The method according to claim 12, wherein a second label is printed and positioned in a second label acceptance position.

14. The method according to claim 13, wherein the labels are positioned in the label acceptance positions with adhesive sides facing one another, wherein during the step of the moving of the handling system together with the product from the product pickup position into the first label acceptance position the first label is picked up by the product and adheres thereon, wherein the handling system is then moved together with the product from the first label acceptance position to the second label acceptance position, and wherein the second label is picked up by the product and adheres thereon.

15. The method according to claim 13, wherein the first label acceptance position is identical to the second label acceptance position, and wherein during the step of moving of the handling system together with the product from the product pickup position into the first label acceptance position both the first label and also the second label are picked up by the product and adhere thereon.

16. The method according to claim 13, wherein the second label acceptance position is located downstream of the first label acceptance position, wherein the handling system together with the product is moved from the first label acceptance position to the second label acceptance position, and wherein the second label is picked up by the product and adheres thereon.

17. The method according to claim 12, wherein the first label and the second label adhere to different sides of the product.

18. The method according to claim 12, wherein the handling system in the first and/or second label acceptance position is positioned in at least two different orientations relative to the label outlet.

19. The method according to claim 12, wherein the handling system together with the product is moved from the first label acceptance position or the second label acceptance position into a packaging position, in which the labelled product is put down onto a carrier.

20. The method according to claim 12, wherein during the step of weighing, multiple products are weighed simultaneously.

21. The method according to claim 12, wherein, after the step of weighing, the product(s) is/are transported from the at least one scale onto a product buffer, and wherein the product pickup position is located within the product buffer or adjoining the product buffer.

22. The method according to claim 12, wherein, after the step of weighing, the product(s) is/are directly picked up from the at least one scale by the handling system.

23. The method according to claim 12, wherein the labelled product passes through a quality control device.

24. The method according to claim 12, wherein multiple products simultaneously pass through the following method steps:

providing the product;

weighing the product;

fixing the product on a handling system in a product pickup position, printing a first label and positioning the first label in a first label acceptance position;

moving the handling system together with the product from the product pickup position to the first label acceptance position, wherein the first label is picked up by the product and adheres thereon; and moving the handling system together with the product away from the first label acceptance position.

* * * * *